US005580443A

United States Patent [19]

Yoshida et al.

[11] Patent Number: 5,580,443

[45] Date of Patent: Dec. 3, 1996

[54] PROCESS FOR CRACKING LOW-QUALITY FEED STOCK AND SYSTEM USED FOR SAID PROCESS

[75] Inventors: Masahiko Yoshida; Yutaka Kitayama; Tsukasa Iida, all of Chiba, Japan

[73] Assignee: Mitsui Petrochemical Industries, Ltd., Tokyo, Japan

[21] Appl. No.: 241,676

[22] Filed: May 12, 1994

Related U.S. Application Data

[63] Continuation of Ser. No. 924,584, Aug. 6, 1992, abandoned, which is a continuation of Ser. No. 474,049, filed as PCT/JP89/00908, Sep. 4, 1989, published as WO90/02783, Mar. 22, 1990, abandoned.

[30] Foreign Application Priority Data

Sep. 5, 1988 [JP] Japan ..... 63-221653

[51] Int. Cl.[6] ..... C10G 9/36

[52] U.S. Cl. ..... 208/130; 208/132; 208/107; 585/648

[58] Field of Search ..... 585/648; 208/130, 208/132, 107

[56] References Cited

U.S. PATENT DOCUMENTS

| | | | |
|---|---|---|---|
| 3,019,272 | 1/1962 | Steinhofer et al. | 585/648 |
| 3,291,537 | 12/1966 | Frescoln | 585/648 |
| 3,330,760 | 7/1967 | Hirschbeck et al. . | |
| 3,696,166 | 10/1972 | Ozawa et al. | 582/648 |
| 3,718,409 | 2/1973 | Simonetta | 208/130 R |
| 4,426,278 | 1/1984 | Kosters | 208/130 |
| 4,587,011 | 5/1986 | Okamoto et al. | 585/648 |
| 4,615,795 | 10/1986 | Woebcke et al. | 585/648 |
| 4,617,109 | 10/1986 | Wells et al. | 585/648 |
| 4,780,196 | 10/1988 | Alagy et al. | 585/648 |
| 4,906,442 | 3/1990 | Johnson et al. | 585/648 |
| 4,946,582 | 8/1990 | Torihata et al. | 208/203 |
| 4,986,898 | 1/1991 | Torihata et al. | 208/251 R |
| 5,107,060 | 4/1992 | Yan | 208/2 X |

FOREIGN PATENT DOCUMENTS

| | | |
|---|---|---|
| 2854061 | 7/1980 | Germany . |
| 3-111491 | 5/1991 | Japan . |
| 772114 | 4/1957 | United Kingdom . |

*Primary Examiner*—Helane Myers

*Attorney, Agent, or Firm*—Birch, Stewart, Kolasch & Birch, LLP

[57] ABSTRACT

In a process for thermally cracking a low-quality feed stock containing a considerable proportion of heavy fractions such as high-boiling fractions, and evaporation residual oil, and a system used therefor, in which the low-quality feed stock is withdrawn from the preheater of the thermal cracking furnace to separate and remove a required proportion of said heavy fractions and thereafter returned to subject the feed stock to further preheating and thermal cracking. The low-quality feed stock thermally cracked has a predetermined proportion of the heavy fractions removed, and coking in the thermal cracking system at various lines is avoided from occurring.

4 Claims, 3 Drawing Sheets

PROCESS FOR CRACKING LOW-QUALITY FEED STOCK AND SYSTEM USED FOR SAID PROCESS

This application is a continuation of application Ser. No. 07/474,049 filed as PCT/JP89/00908 Sep. 4, 1989 published as WO90/02783 Mar. 22, 1990, now abandoned.

TECHNICAL FIELD

The present invention is directed to a process for thermally cracking a low-quality feed stock containing a substantial proportion of heavy fractions such as high-boiling fractions and evaporation residuum fractions. In the present process, the heavy fractions such as high-boiling fractions and evaporation residuum fractions are separated and removed prior to the thermal cracking of the feed stock to carry out a preferable thermal cracking. The present invention is also directed to a system used for said process.

BACKGROUND TECHNOLOGY

Conventional thermal cracking or pyrolysis of naphtha into olefins have been carried out in a naphtha-cracking system wherein all of the charged feed stock is evaporated in a preheater tube provided in a convection section of a thermal cracking furnace, thermally cracked in a reaction tube provided in a radiant section of the thermal cracking furnace, and then cooled in a quenching heat exchanger. Such a conventional cracking system had a construction as illustrated in FIG. 3. As shown in FIG. 3, a cracking system 60 comprises a thermal cracking furnace 12, a quenching heat exchanger 14, and numerous lines. The thermal cracking furnace 12 is divided into a convection section 18 of the thermal cracking furnace and a radiant section 20 of the thermal cracking furnace. In the convection section 18 of the thermal cracking furnace, a feed stock a' such as naphtha is introduced through a feed stock-supplying line 34 provided outside the furnace into a first preheater 22 where the feed stock a' is preheated to produce a preheated feed stock b'. The preheated feed stock b' is introduced through a connecting line 62 to a second preheater 26 where the feed stock b' is additionally preheated to produce a fully preheated feed stock i'. The preheated feed stock b' is evaporated prior to its introduction into the second preheater 26 by admixing superheated dilution steam c supplied through a connecting line 64. The superheated dilution steam c is produced in a dilution steam superheater tube 28 wherein steam introduced through a dilution steam-supplying line 44 from outside the furnace is superheated.

The fully preheated feed stock i' preheated in the second preheater 26 is passed through a connecting line 46 to a thermal cracking reactor 30, where it is thermally cracked into reaction products j. The reaction products j are passed through a connecting line 48 to a quenching heat exchanger 14, where they are cooled to produce cooled products k. The cooled products k are passed through a product discharge line 50 to further processing.

The conventional cracking system 60 as described above has been effective for cracking high-quality feed stocks such as naphtha.

However, cracking of low-quality feed stocks such as HNGL (heavy natural gas liquid, an associated oil occurring in small quantity with production of gas from gas fields) is recently required in addition to naphtha which has been conventionally employed for the cracking purpose.

DISCLOSURE OF THE INVENTION

When such a low-quality feed stock containing a substantial portion of heavy fractions including high-boiling fractions and evaporation residuum fractions are thermally cracked in a conventional system such as the one shown in FIG. 3 adapted for cracking high-quality feed stocks such as naphtha, there are encountered the following two problems:

(1) evaporation residuum is deposited within the tubes of the preheaters 22 and 26 in the convection section 18 of the cracking furnace, especially within the tube of the preheater 26 where the feed stock is completely evaporated, to cause so called coking and impede the stream flowing therethrough leading to shut-down after short period of operation; and (2) a large amount of substances which are likely to cause coking problems are produced in the thermal cracking reactor 30, and such substances are condensed in the quenching heat exchanger 14 to cause coking and impede heat conduction, immediately resulting in an increased exit temperature and pressure loss at the quenching heat exchanger, leading to shut-down.

As set forth above, the heavy fractions included in the low-quality feed stock were one of the main causes of the coking problems in the preheater lines kept at 200° to 600° C., the connecting lines, and the quenching heat exchanger, resulted in increase of gas temperature in the preheater lines and exit of the quenching heat exchanger in addition to pressure loss in the aforementioned lines, leading to shut-down after short period of operation.

An object of the present invention is to solve the various problems of the prior art as set forth above, and provide a process for cracking a low-quality feed stock and a system used for such a process wherein a low-quality feed stock containing a substantial portion of heavy fractions, such as high-boiling fractions and evaporation residuum fractions, is used as a feed stock for producing olefins, wherein the feed stock is thermally cracked after removing such heavy fractions as high-boiling fractions and evaporation residuum fractions by withdrawing the feed stock from a preheater in a thermal cracking furnace to separate the heavy fractions to thereby avoid coking problems in various lines of the thermal cracking system, in particular, in connecting lines and preheater lines as well as quenching heat exchanger in order to enable a prolonged operation even when such a low-quality feed stock is used.

To achieve the above-described objects, there is provided by the present invention a process for thermally cracking a low-quality feed stock containing heavy fractions in a cracking furnace, wherein said low-quality feed stock is withdrawn from a preheater of the cracking furnace to separate and remove a required proportion, for example, 2 to 40% of the heavy fractions from said low-quality feed stock by a gas-liquid separation, and wherein said low-quality feed stock is returned to said preheater before subjecting said feed stock to a thermal cracking.

In accordance with the present invention, there is also provided a process wherein, in said process for cracking a low-quality feed stock, evaporation rate of the feed stock is controlled by introducing a required amount of superheated dilution steam to the low-quality feed stock withdrawn from said preheater.

Further, there is provided in accordance with the present invention a thermal cracking system for thermally cracking a low-quality feed stock containing heavy fractions comprising a cracking furnace comprising a thermally cracking convention section including a first preheater and a second preheater and a thermally cracking radiant section disposed in the downstream of said thermally cracking convection section including a thermally cracking reactor; a gas-liquid separator for removing said heavy fractions from said low-quality feed stock; a low-quality feed stock-supplying line connected to said first preheater; a line connecting said first preheater and said gas-liquid separator; and a line connecting said gas-liquid separator and said second preheater.

Still further, there is provided in accordance with the present invention a system wherein, in said system for thermally cracking a low-quality feed stock, a line is provided to connect said line connecting said gas-liquid separator and said first preheater and/or said line connecting said gas-liquid separator and said second preheater with a dilution steam superheater tube for supplying superheated dilution steam.

BEST MODE FOR CARRYING OUT THE INVENTION

A process for cracking a low-quality feed stock and a system employed for carrying out said process in accordance with the present invention are hereinafter described in detail.

Low-quality feed stocks employed in the present invention may be any feed stock oils adapted for cracking insofar as they may be cracked into various olefins, and may contain heavy fractions such as high-boiling fractions and evaporation residuum fractions. Such low-quality feed stocks include HNGL (heavy natural gas liquid) which has recently attracted attention as a feed stock adapted for cracking. The HNGL is an associated oil occurring in a small quantity in the production of natural gas from natural gas fields.

The evaporation residuum fractions, are fractions which remain as evaporation residuum in preheaters provided in a cracking furnace for cracking the feed stock. The high-boiling fractions, are fractions which do evaporate in the preheater, but which are likely to produce high-boiling substances which condense in a quenching heat exchanger after the cracking.

The low-quality feed stocks employed in the present invention include, not only those heavy fraction-containing feed stocks adapted for cracking such as HNGL as mentioned above, but also those having an appropriate proportion of high-quality feed stocks such as naphtha blended thereto.

The cracking system for carrying out the process for cracking a low-quality feed stock in accordance with the present invention is described in detail by referring to a preferred embodiment illustrated in the attached drawing.

Figure 1:
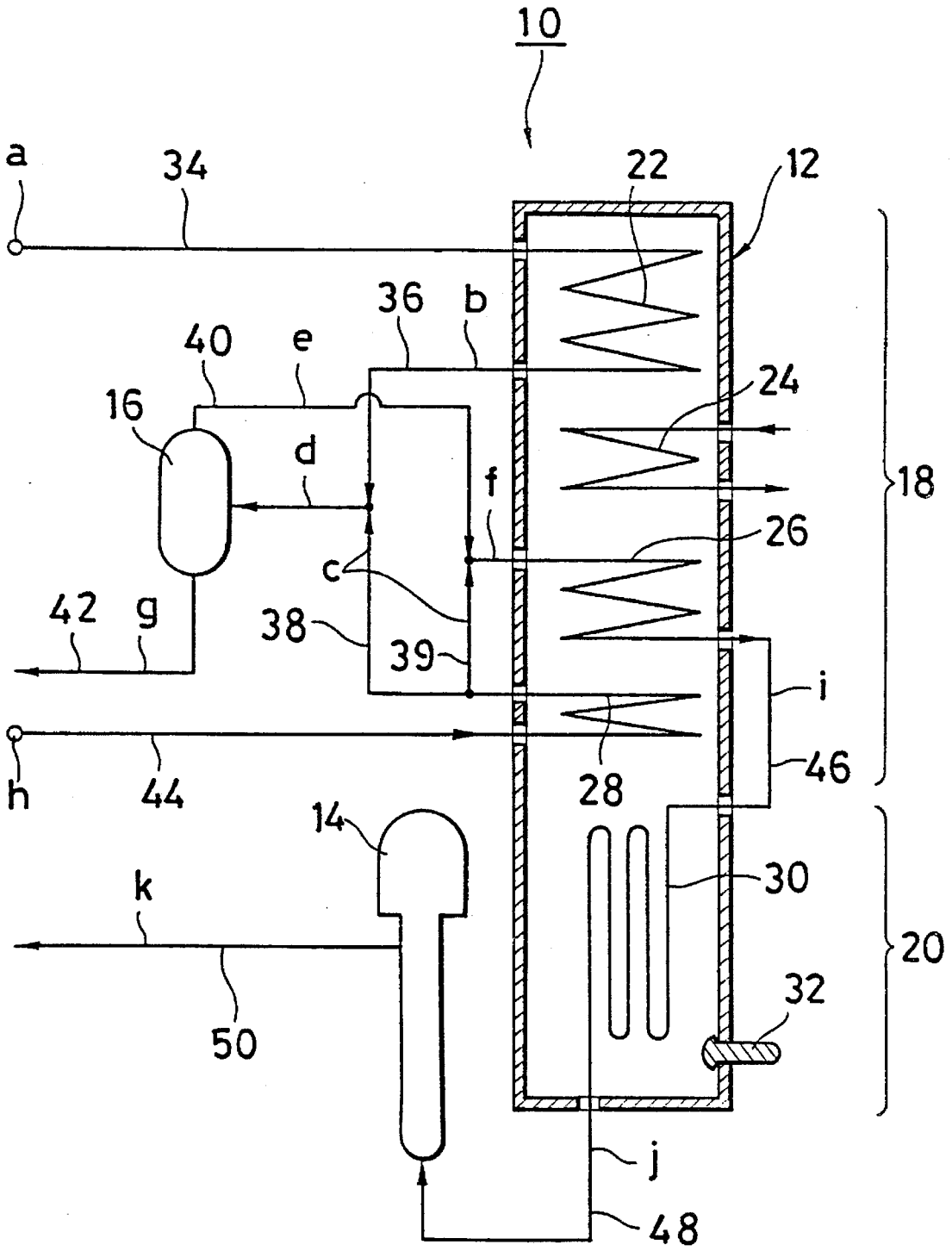
FIG. 1 is a schematic diagram of a cracking system for carrying out a process of the present invention wherein a low-quality feed stock is cracked.

FIG. 1 is a diagram schematically illustrating the cracking system. As illustrated in FIG. 1, a cracking system 10 mainly comprises a thermal cracking furnace 12, a quenching heat exchanger 14, a gas-liquid separator 16 which characterize the present invention, and various lines.

The thermal cracking furnace 12 comprises a convection section 18 in the upper part of the thermal cracking furnace 12 and a radiant section 20 in the lower part of the thermal cracking furnace 12. In the convection section 18 of the thermal cracking furnace, there are disposed a tube-type first preheater 22, an economizer tube 24, a tube-type second preheater 26, and a tube-type dilution-steam superheater 28, from the top to the bottom. In the radiant section 20 of the cracking furnace are disposed a thermal cracking reactor 30 comprising a tubular reactor, and a burner 32 for heating the cracking furnace.

In the convection section 18 of the thermal cracking furnace, a feed-stock supplying line 34 for supplying a low-quality feed stock a from outside the cracking furnace 12 to the first preheater 22 is connected to the entrance of the first preheater 22, where the low-quality feed stock a is preheated to produce a preheated low-quality feed stock to The first preheater at its exit is connected to a withdrawing line 36 for withdrawing the preheated low-quality feed stock b from the cracking furnace 12. The withdrawing line 36 joins with a connecting line 38 delivering superheated dilution steam c provided in the downstream of the dilution-steam superheater 28. The withdrawing line 36 is then connected to the gas-liquid separator 16 in the downstream of the joint.

The gas-liquid separator 16 at its top is connected a gas-delivering line 40 for delivering a gaseous feed stock e separated in the gas-liquid separator 16. The line 40 joins with a branch line 39 branched from the line 38, and is then connected to the second preheater 26 in the cracking furnace 12. The gas-liquid separator 16 at its bottom is connected to a heavy fraction-discharge line 42 for discharging heavy fractions g separated in the gas-liquid separator 16.

A dilution steam-supplying line 44 is connected to the dilution steam superheater 28 at its entrance for supplying a dilution steam h from outside the cracking furnace 12.

The thermal cracking reactor 30 in the radiant section 20 of the thermal cracking furnace 12 is connected at its entrance to the exit of the second preheater 26 through a connecting line 46. The thermal cracking reactor 30 in the radiant section 20 of the thermal cracking furnace is connected at its exit to the quenching heat exchanger 14 disposed outside the cracking furnace 12 through a connecting line 48.

To the quenching heat exchanger 14 is connected a product discharge line 50 for discharging and recovering reaction products j such as an olefin cooled in the quenching heat exchanger 14.

In the present system, the first preheater 22 is provided to preheat the low-quality feed stock a containing the above-mentioned high-boiling fractions and the evaporation residuum fractions. The first preheater 22 may preferably be kept at a non-limited temperature and a non-limited pressure in the range capable of allowing for fractions unlikely to produce cracked substances causing coking problems when condensed in the quenching heat exchanger 14 after the reaction in the thermal cracking reactor 30 to be fully evaporated, but maintaining fractions causing coking problems in the lines such as the second preheater leading to pressure loss and temperature increase as well as fractions likely to produce cracked substances causing coking problems after the thermal cracking non-evaporated. Such ranges of temperature and pressure in the first preheating stage are determined in accordance with the type and properties of the low-quality feed stock, and with performance and operational conditions of the gas-liquid separator 16, the thermal cracking furnace 12, and in particular, the thermal cracking reactor 30 and the quenching heat exchanger 14. For example, the pressure of the gas-liquid separator 16 may be kept from 2 to 12 kg/cm$^2$G, and preferably from 3 to 7 kg/cm$^2$G, and the temperature of the first preheating stage may be controlled by maintaining the exit temperature of the preheater 22 in the range of from 150° to 350° C., and preferably from 200° to 300° C.

As mentioned above, the preheated low-quality feed stock b which has been preheated in the first preheating stage contains a considerable proportion of fractions which will remain as evaporation bottoms in the preheater 26 provided in the convection section 18 of the thermal cracking furnace 12, as well as fractions which are likely to produce cracked substances causing coking problems in the quenching heat exchanger 14 after the thermal cracking reaction. These heavy fractions, however, have high boiling points of, for example, 300° C. or higher, and are difficult to evaporate. Accordingly, the heavy fractions or nonrequisite fractions are to be found mainly in liquid phase. Such a low-quality feed stock b is in a gas-liquid mixed conditions at a gas/liquid ratio of from 60/40 to 98/2, and preferably from 70/30 to 95/5. The low-quality feed stock b is mixed with a suitable amount of the superheated dilution steam c to adjust the gas/liquid ratio and produce an adjusted low-quality feed stock d, which is introduced into the gas-liquid separator 16, wherein the adjusted low quality feed stock d is separated into liquid phase, namely, liquid heavy fractions g mostly comprising high-boiling fractions and evaporation residuum fractions and gas phase, namely, a gas feed stock e containing little such heavy fractions g. The heavy fractions g are discharged and removed from the system through the heavy fraction-discharge line 42. On the other hand, the gas feed stock e is passed through the gas-delivering line 40, mixed with the superheated dilution steam c supplied through the branch line 39, and then passed to the second preheater 26. Preferably, a required level, for example, from 2 to 40% of the heavy fractions may be separated and removed from the low-quality feed stock in the gas-liquid separator 16.

In the second preheater 26, the feed stock is fully preheated to a temperature below the temperature at which cracking is promoted (up to 700° C.) to produce a fully preheated gaseous feed stock i. The fully preheated gaseous feed stock i is then introduced through the connecting line 46 into the thermal cracking reactor 30 to undergo a sufficient thermal cracking to produce the reaction products j, which are passed through the connecting line 48 to the quenching heat exchanger 14 provided outside the furnace 12.

Cooled reaction products k quenched in the quenching heat exchanger 14 is passed to further processing through the product discharge line 50.

Non-limited preheaters 22 and 26 employed in the system for carrying out the process of the present invention include a tube-type preheater.

Any desired economizer 24 may be utilized insofar as it adjusts the preheating temperatures of the preheaters 22 and 26 to preferable ranges.

The dilution steam superheater 28 employed is also not limited to a particular type, and a superheater tube may be employed. The superheated dilution steam c is capable of promoting evaporation of HC (hydrocarbons) and adjusting the gas/liquid ratio of the preheated low-quality feed stock b. Therefore, evaporation ratio of the feed stock may be controlled by adjusting the quantity of the superheated dilution steam c admixed with the preheated low-quality feed stock b. Such an adjustment, not only obviates the coking problems in lines and the like due to the presence of heavy fractions, but also enables to fully correspond to different types and properties of the low-quality feed stocks a resulting from, for example, different gas fields. Accordingly, a preferable thermal cracking is realized since there is no need to change operational conditions of the thermal cracking system to correspond to different feed stocks from different gas fields.

Optionally, the quantity of the superheated dilution steam admixed may be automatically controlled in accordance with the present process to correspond to feed stocks from different gas fields having different contents of heavy fractions, and the like.

Non-limited thermal cracking reactors 30 employed include a tube-type thermal cracking reactor.

Non-limited quenching heat exchanger 14 employed include known heat exchangers of conventional type.

Any known gas-liquid separator 16 of conventional type may be employed in the present process insofar as the liquid phase containing the heavy fractions g and the gas phase containing the gas feed stock e can be preferably separated.

The process for cracking a low-quality feed stock and the system employed in such a process of the present invention are hereinafter described illustratively by referring to an experiment.

Figure 2:
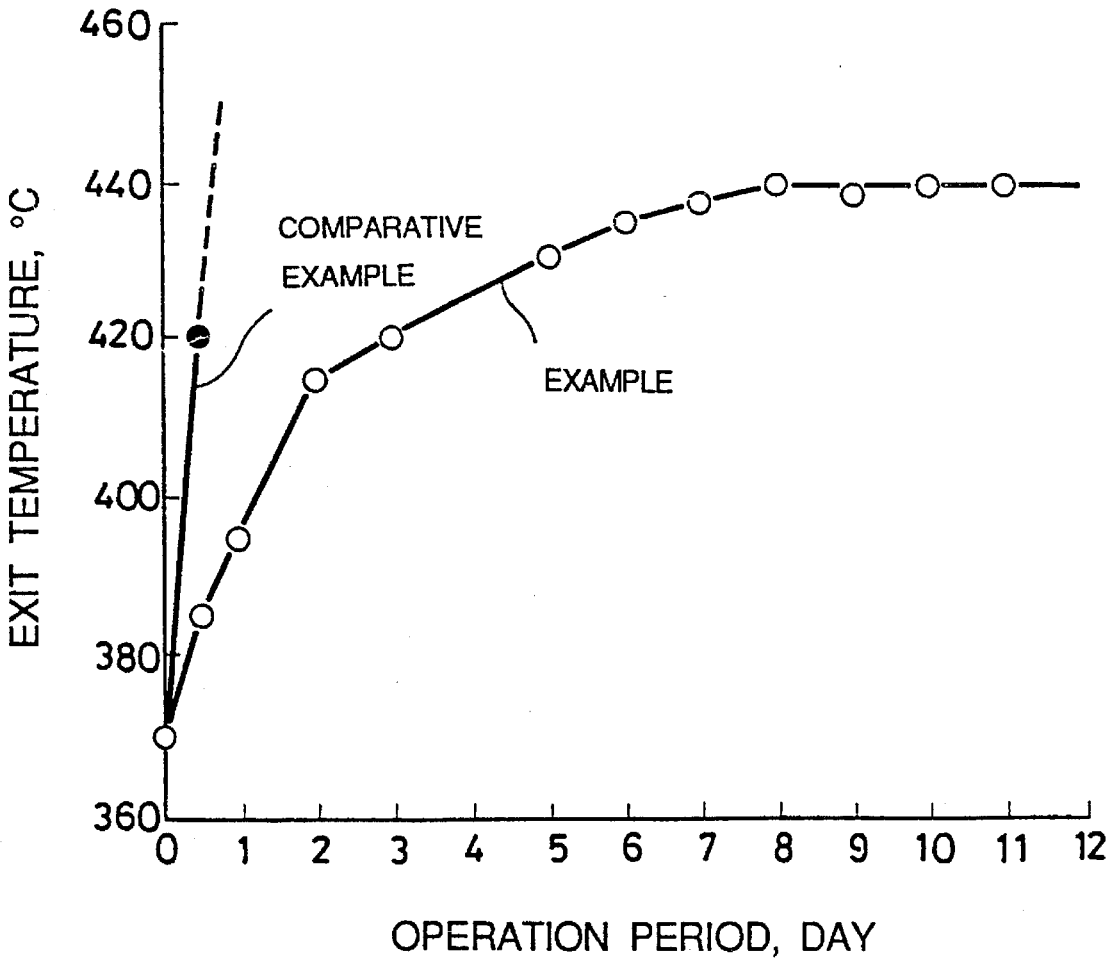
FIG. 2 is a diagram illustrating exit temperature of the quenching heat exchanger in relation to operation period in day for an example of the present invention and a comparative example.
Figure 3:
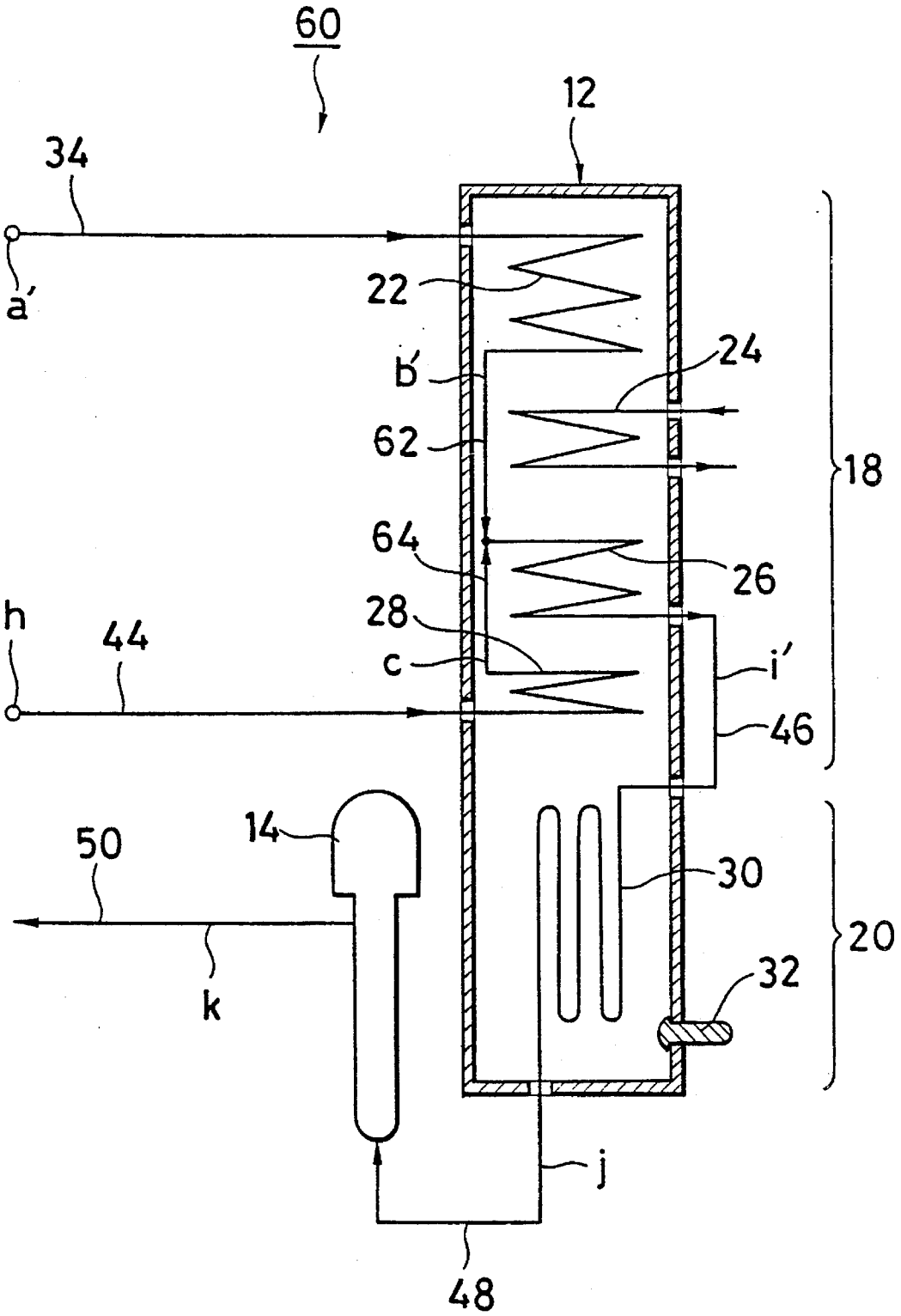
FIG. 3 is a schematic diagram of a cracking system of the prior art.

FIG. 2 shows change of exit temperature of the quenching heat exchanger 14 in relation to operation period in day when a low-quality feed stock containing a considerable portion of heavy fractions such as high-boiling fractions and evaporation residuum fractions is subjected to a gas-liquid separation to remove 5 to 20% of the liquid components and then thermally cracked by using the thermal cracking system shown in FIG. 1 as an example of the present invention.

FIG. 2 also shows the change of exit temperature of the quenching heat exchanger 14 in relation to the operation period in day when the same low-quality feed stock as used in the example of the present invention is subjected to the thermal cracking without removing any heavy fractions from the feed stock by using the conventional thermal cracking system shown in FIG, 3 as a comparative example.

Completely same thermal cracking conditions were employed in the example of the present invention and in the comparative example except for the gas-liquid separation.

| Thermal cracking conditions | |
|---|---|
| Low-quality feed stock a | 6.0 atm., 15° C., 30,000 kg/h |
| First preheating temperature | 233° C. |
| Superheated dilution steam | 4.8 atm., 448° C. |
| Quantity of superheated dilution steam admixed | |
| Preheated low-quality feed stock b | 5,000 kg/h |
| Gas feed stock e | 8,500 kg/h |
| Second preheating temperature | 547° C. |
| Thermal cracking temperature | 832° C. |
| Heavy fractions separated and removed | 3,000 kg/h |

As evidenced in FIG. 2, temperature increase was effectively suppressed in the example of the present invention to enable a prolonged operation while temperature increase was so high throughout the operation inevitably resulting in a shut-down after short operation in the comparative-example.

INDUSTRIAL UTILITY

As precisely described above, in the thermal cracking of the low-quality feed stock containing a considerable proportion of heavy fractions such as high-boiling fractions and evaporation residual oil in accordance with the present invention, the low-quality feed stock is withdrawn from the preheater of the thermal cracking furnace after the first preheating stage to separate and remove said heavy fractions, and thereafter returned to subject the feed stock to second preheating stage and the thermal cracking. Therefore, coking problems in the cracking system can be avoided from occurring at various lines, the thermal cracking furnace, and the quenching heat exchanger, in particular, at various lines in the downstream of the first preheater. Since the coking problems are obviated, pressure loss at various lines in the cracking system, temperature increase at the lines of the preheaters, and in particular, temperature increase at the exit of the quenching heat exchanger can be prevented to significantly prolong the period of operation.

Furthermore, in the present invention, the low-quality feed stock is preheated in two stages. Therefore, the superheated dilution steam can be introduced after the first preheating stage to prevent coking and to supply additional heat to the low-quality feed stock. In this case, evaporation rate of the low-quality feed stock can be adjusted by varying the quantity of the superheated dilution steam introduced to control the proportion of the heavy fractions separated and removed from said low-quality feed stock. Consequently, the present invention can correspond to different low-quality stocks from different gas fields by using the same system at similar operational conditions.

We claim:

1. A process for thermally cracking a heavy natural gas liquid containing heavy fractions in a cracking furnace having a convection zone containing a first preheater and a second preheater and a radiation zone containing a thermally cracking reactor comprising the steps of:

supplying said heavy natural gas liquid to the first preheater provided in a top portion of said convection zone of the cracking furnace;

preheating the supplied heavy natural gas liquid to a temperature and pressure at which fractions unlikely to cause coking problems are fully evaporated and fractions likely to cause coking problems are maintained in a liquid phase, in the first preheater and maintaining an exit temperature thereof in the range of from 200° to less than 300° C. and a gas/liquid ratio of the preheated heavy natural gas liquid in the range of from 60/40 to 98/2;

withdrawing the preheated heavy natural gas liquid from said first preheater;

superheating a suitable amount of dilution steam at a temperature higher than that of the preheated heavy natural gas liquid;

mixing a required amount of superheated dilution steam with the heavy natural gas liquid from said first preheater through a connection line between said first preheater and a gas-liquid separator to obtain an adjusted gas/liquid ratio of the heavy natural gas liquid, corresponding to the properties of differing heavy natural gas liquid feedstocks, to result in a predetermined gas/liquid separation in said gas-liquid separator;

supplying said mixture of said superheated dilution steam and said heavy natural gas liquid, having an adjusted gas/liquid ratio, to said gas-liquid separator;

separating and removing the heavy fractions from the withdrawn heavy natural gas liquid in said gas-liquid separator;

mixing the heavy-fraction-removed heavy natural gas liquid from the separator with a remaining amount of the superheated dilution steam necessary for thermal cracking;

passing said heavy-fraction-removed heavy natural gas liquid from the gas-liquid separator to said second preheater provided in said convection zone of the cracking furnace;

preheating the passed heavy-fraction-removed heavy natural gas liquid to a temperature below the temperature at which cracking is promoted;

introducing the preheated heavy-fraction-removed heavy natural gas liquid into the thermally cracking reactor; and thermally cracking the introduced heavy-fraction-removed heavy natural gas liquid in said thermally cracking reactor.

2. The process for thermally cracking a heavy natural gas liquid according to claim 1 wherein a pressure of said gas-liquid separation is in a range of from 2 to 12 $kg/cm^2G$.

3. The process for thermally cracking a heavy natural gas liquid according to claim 1 wherein said heavy natural gas liquid is fully preheated to a temperature below the temperature at which the thermal cracking is promoted in the second preheater.

4. The process for thermally cracking a heavy natural gas liquid according to claim 1, wherein said gas/liquid ratio of the preheated heavy natural gas liquid is adjusted in a range of from 70/30 to 95/5.

* * * * *